US005848876A

United States Patent [19]

Tomita

[11] Patent Number: 5,848,876

[45] Date of Patent: Dec. 15, 1998

[54] COOLING SYSTEM FOR COOLING PLATFORM OF GAS TURBINE MOVING BLADE

[75] Inventor: Yasuoki Tomita, Takasago, Japan

[73] Assignee: Mitsubishi Heavy Industries, Ltd., Tokyo, Japan

[21] Appl. No.: 798,995

[22] Filed: Feb. 11, 1997

[51] Int. Cl.[6] ..... F01D 5/08

[52] U.S. Cl. ..... 416/96 R; 416/97 R; 415/115

[58] Field of Search ..... 416/97 R, 96 R; 415/115

[56] References Cited

U.S. PATENT DOCUMENTS

| | | | |
|---|---|---|---|
| 2,603,453 | 7/1952 | Sollinger . | |
| 4,012,167 | 3/1977 | Noble . | |
| 4,017,213 | 4/1977 | Prziembel | 416/97 A |
| 5,281,097 | 1/1994 | Wilson et al. . | |
| 5,344,283 | 9/1994 | Magowan et al. . | |
| 5,413,458 | 5/1995 | Caderbank | 415/115 |
| 5,639,216 | 6/1997 | McLaurin et al. | 416/95 |

FOREIGN PATENT DOCUMENTS

| | | | |
|---|---|---|---|
| 765225 | 1/1957 | United Kingdom | 416/96 |
| WO 96/13653 | 5/1996 | WIPO . | |

*Primary Examiner*—Edward K. Look
*Assistant Examiner*—Richard Woo
*Attorney, Agent, or Firm*—Wenderoth, Lind & Ponack, L.L.P.

[57] ABSTRACT

An effective cooling structure that is intended to cool a platform of a gas turbine moving blade. Cooling air passages (B1, C1, D1; B2, C2, D2; and B3, C3 and D3) are provided through the interior and along the peripheral edge of the platform (2) to thereby cause a cooling air to pass therethrough.

3 Claims, 4 Drawing Sheets

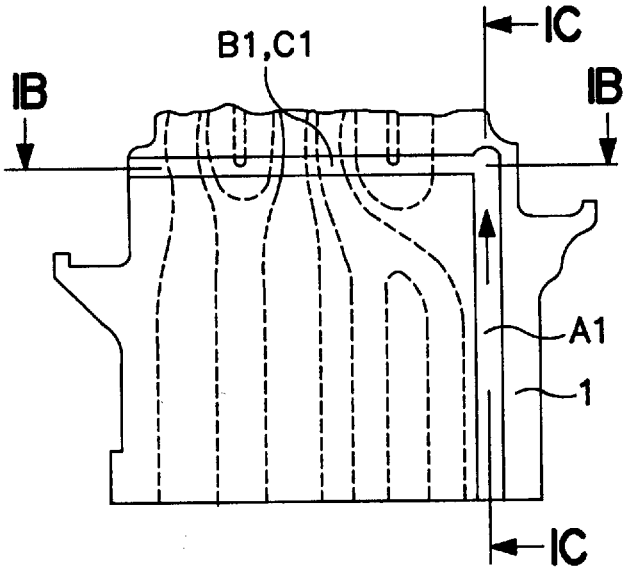
FIG. IA
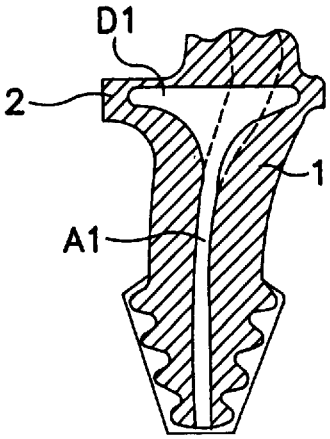
FIG. IC
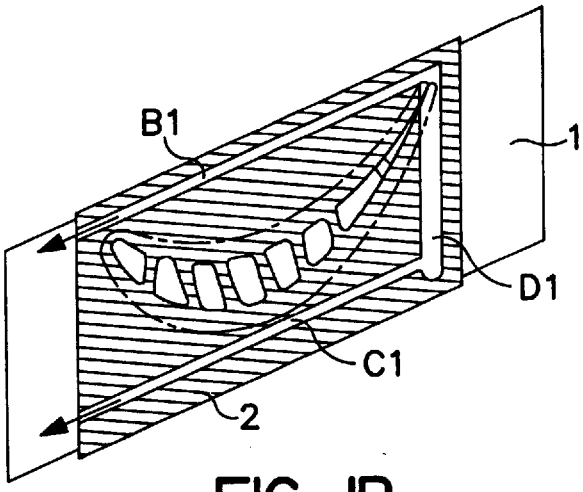
FIG. IB

COOLING SYSTEM FOR COOLING PLATFORM OF GAS TURBINE MOVING BLADE

BACKGROUND OF THE INVENTION

1. Technical Field

The present invention relates to a cooling structure for cooling the platform of a gas turbine moving blade.

2. Description of the Related Art

FIG. 4 is a longitudinal sectional view illustrating an example of a conventional gas turbine hollow moving blade.

The cooling air for cooling the blade flows therein from a bottom portion of a blade root (11) and flows in directions indicated by the arrows to thereby cool the moving blade. That is, a cooling air (12A) that has flown from a blade head (forward edge) side flows through a flow passage that has a tabulator (13) and flows out from openings that have been formed in the blade head portion and a blade top portion provided with a tip thinning (14), whereby the cooling air merges into a main gas flow. Also, a cooling air (12B) that has flown in from a blade tail (backward edge) side flows in the directions indicated by the arrows through a cooling passage provided with the tabulator (13) to thereby cool the blade tail portion by means of pin fins (15), after which the cooling air (12B) flows out from openings or slits (16) and merges into the main gas flow. Also, a cooling air (12C) that has flown in from a central part of the blade (12C) flows in the directions indicated by the arrows through a cooling passage provided with the tabulator (13) and flows out mainly from the openings formed in the blade top portion, whereby the cooling air (12C) merges into the main gas flow.

As the increase in temperature of the gas turbine proceeds, there arises a demand for increasing the cooling power for cooling the gas turbine portion. For this reason, a high level of cooling structure has been adopted in the blade portion of the moving blade. In contrast to this, regarding the cooling of the platform, there is no decisive cooling method though several cooling methods have been made publicly known. For this reason, it often happens that the platform becomes high in temperature, which results in the occurrence of high temperature oxidation and low cycle fatigue.

OBJECT OF THE INVENTION

In view of the above, it is an object of the present invention to provide a cooling system for cooling the platform of a gas turbine moving blade.

SUMMARY OF THE INVENTION

To attain the above object, according to a first aspect of the present invention, there is provided a cooling system for cooling the platform of a gas turbine moving blade, which is arranged to supply a cooling air from a blade root portion on a blade tail side of the gas turbine moving blade and which has provided therein an air passage that passes sequentially through the interior in the vicinity of the blade tail of the platform and through the both sideward interior portions of the platform and that is released to an end face on a blade head side of the platform.

Also, to attain the above object, according to a second aspect of the present invention, there is provided a cooling system for cooling the platform of a gas turbine moving blade, which is arranged to supply cooling air from a blade root portion on a blade head side of the gas turbine moving blade and which has provided therein an air passage that passes sequentially through the interior in the vicinity of the blade head of the platform and through the both sideward interior portions of the platform and that is released to an end face on a blade tail side of the platform.

Further, also, to attain the above object, according to a third aspect of the present invention, there is provided a cooling system for cooling the platform of a gas turbine moving blade, which is arranged to supply cooling air from a blade root portion on a blade tail side of the gas turbine moving blade and which has provided therein an air passage that passes sequentially through the interior in the vicinity of the blade tail of the platform and through the both sideward interior portions of the platform and that is released in the blade root direction in the vicinity of an end face on a blade head side of the platform.

Since the cooling system for cooling the platform of a gas turbine moving blade according to the present invention has the above-mentioned construction, it is possible to introduce cooling air from the blade root portion on the blade tail or head side of the gas turbine moving blade and to cause this cooling air to flow sequentially through the interior in the vicinity of the blade tail or head of the platform and through the both sideward interior portions of the platform and thereafter flow out to the end face on the blade head or tail side or in the blade root direction of the moving blade. Accordingly, it is possible to cool the platform of the moving blade effectively.

BRIEF DESCRIPTION OF THE DRAWINGS

FIGS. 1(*a*), 1(*b*) and 1(*c*) are views illustrating a first embodiment of the present invention, FIG. 1(*a*) being a longitudinal sectional view illustrating a blade root portion of a gas turbine moving blade, FIG. 1(*b*) being a sectional view taken along a line 1B—1B of FIG. 1(*a*), and FIG. 1(*c*) being a sectional view taken along a line 1C—1C of FIG. 1(*a*);

DETAILED DESCRIPTION OF THE PREFERRED EMBODIMENTS

In the first embodiment shown in FIGS. 1(*a*), 1(*b*) and 1(*c*), a cooling air passage (A1) is formed in a blade root portion (1) on a blade tail side of a moving blade in the direction of the blade axis. Also, two parallel cooling air passages (B1) and (C1) are formed respectively in both side portions in the circumferential direction of a platform (2). Also, the air passage (A1) of the blade root portion and the air passages (B1) and (C1) located on the side portions of the platform are caused to communicate with each other by an air passage (D1) formed in the interior in the vicinity of the blade tail of the platform. Portions on the blade head side of the parallel air passages (B1) and (C1) are open.

The cooling air that has been introduced from the cooling air passage (A1), that has been provided in the portion on the blade tail side of the blade root, flows through the air passages (D1), (B1) and (C1) are formed in the outer-peripheral portion of the platform (2) and thereby cools the platform (2) and then flows out from the open portions thereof on the blade head side of the platform (2).

Figure 2A:
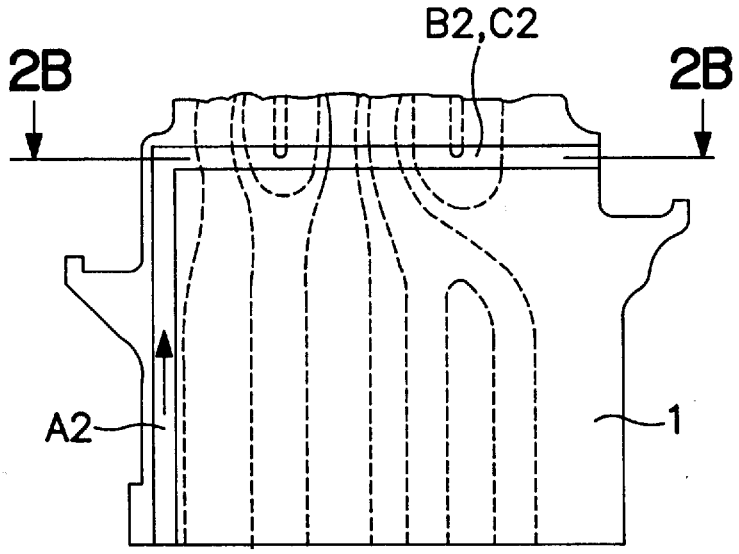
FIGS. 2(*a*) and 2(*b*) are views illustrating a second embodiment of the present invention, FIG. 2(*a*) being a longitudinal sectional view illustrating a blade root portion of a gas turbine moving blade, and FIG. 2(*b*) being a sectional view taken along a line 2B—2B of FIG. 2(*a*)
Figure 2B:
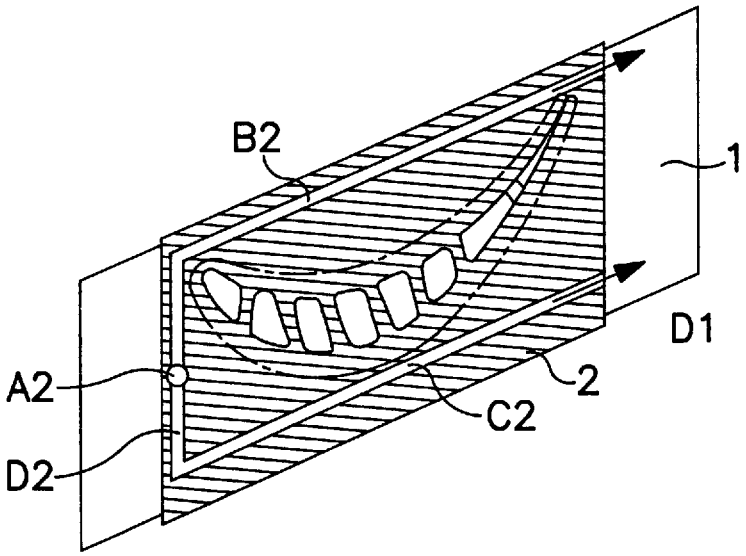

Next, in the second embodiment shown in FIGS. 2(*a*) and 2(*b*), a cooling air passage (A2) is formed in a blade root portion (1) on a blade head side of a moving blade in the direction of the blade axis. Also, parallel cooling air passages (B2) and (C2) are formed respectively in both side portions in the circumferential direction of a platform (2). Also, the air passage (A2) of the blade root portion and the air passages (B2) and (C2) located on the side portions of the platform are caused to communicate with each other by an air passage (D2) formed in the interior in the vicinity of the blade head of the platform. Portions on the blade tail side of the parallel air passages (B2) and (C2) are open.

The cooling air that has been introduced from the cooling air passage (A2) that has been formed in the portion on the blade head side of the blade root (1) flows through the air passages (D2), (B2) and (C2) that have been formed in the outer-peripheral portion of the platform (2) and thereby cools the platform (2) and then flows out from the open portions thereof on the blade tail side of the platform (2). In the above-mentioned first embodiment, since the cooling air flows out to the blade head side, a pressure is applied to the open ends by the main gas flow, with the result that smooth flow of the cooling air has not been realized. In this embodiment, since the cooling air flows out to the blade tail side, the sucking-out effect that is attributable to the main gas flow is obtained with the result that smooth flow of the cooling air is realized.

Figure 3A:
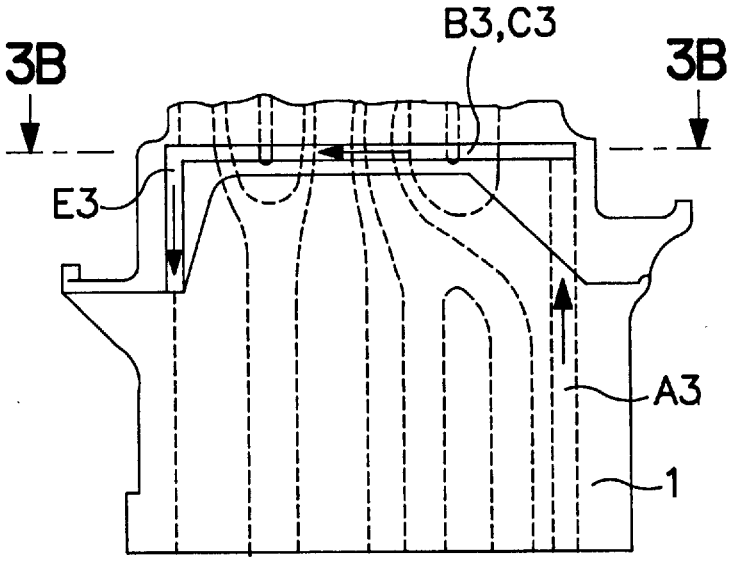
FIGS. 3(*a*) and 3(*b*) are views illustrating a third embodiment of the present invention, FIG. 3(*a*) being a longitudinal sectional view illustrating a blade root portion of a gas turbine moving blade, and FIG. 3(*b*) being a sectional view taken along a line 3B—3B of FIG. 3(*a*)
Figure 3B:
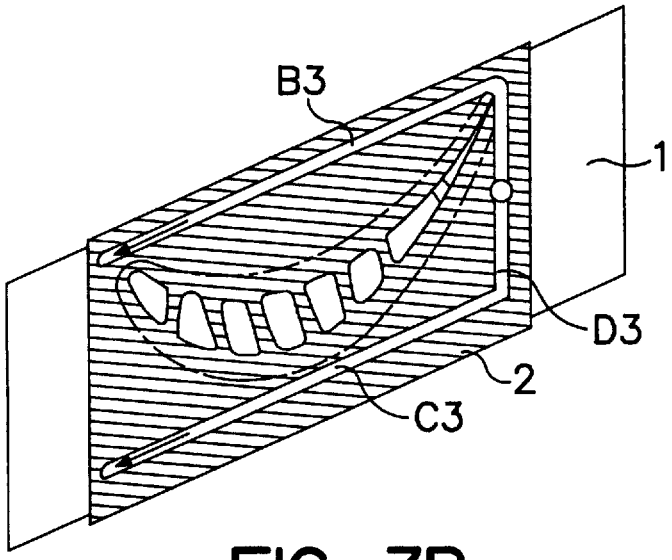
Figure 4:
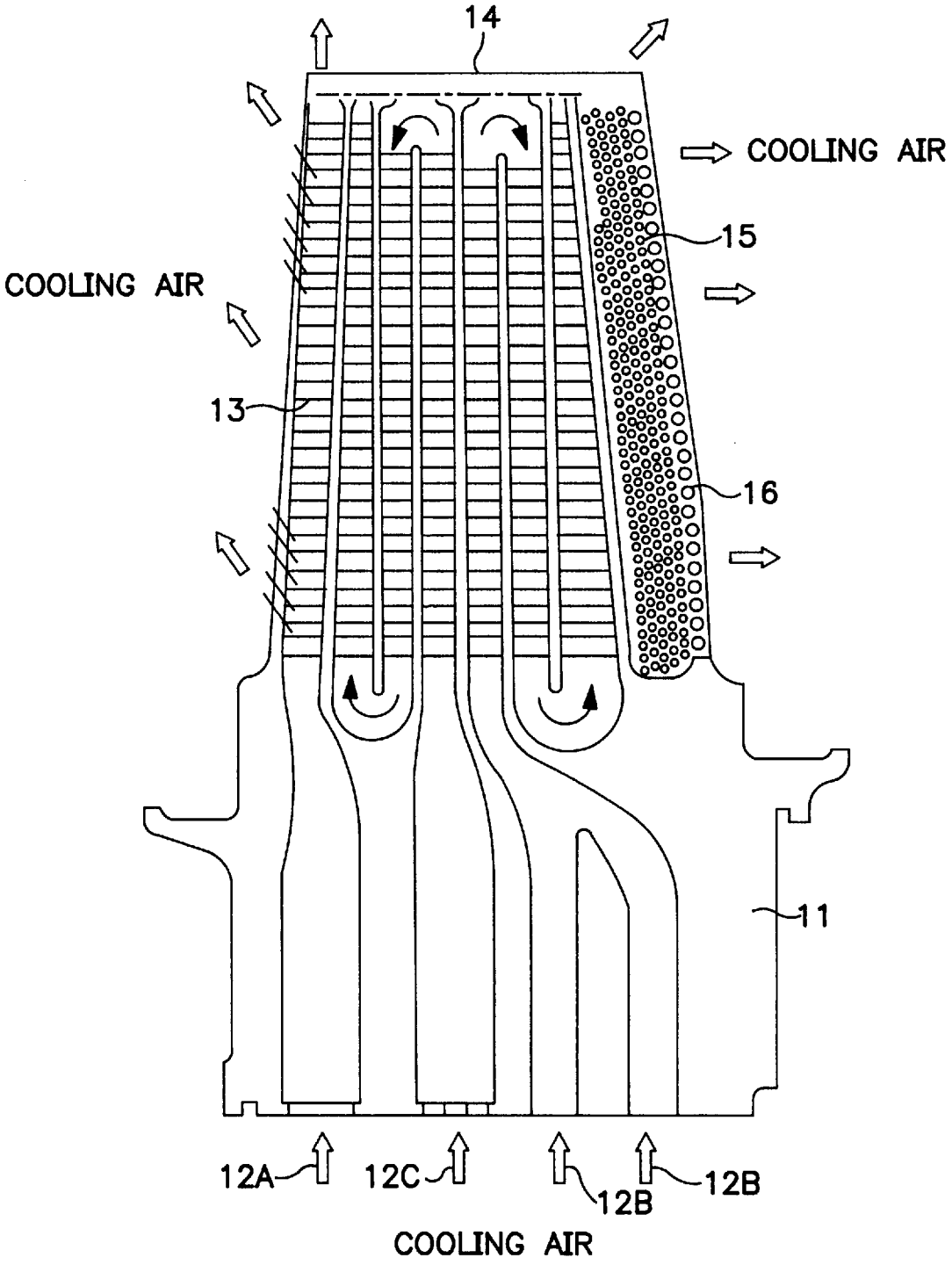
FIG. 4 (PRIOR ART)
FIG. 4 is a longitudinal sectional view illustrating an example of a conventional gas turbine moving blade.

Next, in the third embodiment shown in FIGS. 3(*a*) and 3(*b*), a cooling air passage (A3) is formed in a blade root portion (1) on a blade tail side of a moving blade in the direction of the blade axis. Also, parallel cooling air passages (B3) and (C3) are formed respectively in both side portions in the circumferential direction of a platform (2). Also, the air passage (A3) of the blade root portion and the air passages (B3) and (C3) located on the side portions of the platform are caused to communicate with each other by an air passage (D3) formed in the interior in the vicinity of the blade tail of the platform. Portions on the blade head side of the parallel air passages (B3) and (C3) are made open by being communicated with two corresponding cooling air passages (E3) that have been formed in the blade root in the direction of the blade axis.

The cooling air that has been introduced from the cooling air passage (A3) that has been provided in the portion on the blade tail side of the blade root (1) flows through the air passages (D3), (B3) and (C3) that have been formed in the outer-peripheral portion of the platform (2) and thereby cools the platform (2) and further passes through the air passages (E3) that have been formed in the direction of the blade axis and then flows out in the direction of the blade root. In this embodiment, also, since it does not happen that the cooling air flows out against the main gas flow as in the case of the first embodiment, the cooling air smoothly flows.

In the cooling system for cooling the platform of a gas turbine moving blade according to the present invention, particularly both side portions in the circumferential direction of the platform that are liable to undergo the effect of the heat are sufficiently cooled, with the result that it is possible to prevent the occurrence of high temperature oxidation and low cycle fatigue that are caused by heat. Accordingly, the reliability of the gas turbine moving blade is further enhanced and it is also possible to cope with an increase in temperature thereof.

What is claimed is:

1. A gas turbine blade comprising:

a platform;

a blade portion extending from said platform and having a blade head side and a blade tail side;

a blade root portion connected to said platform; and a cooling system for cooling said platform, said cooling system comprising an air passage that is arranged to cause cooling air, which is supplied from said blade root portion on said blade trail side of said blade portion, to pass sequentially through the interior of said platform in the vicinity of said blade tail side and through opposite sides of said platform between said blade tail side and said blade head side, and then be released at an end face of said platform at said blade head side of said platform.

2. A gas turbine blade comprising:

a platform having a blade head side and a blade tail side;

a blade portion extending from said platform;

a blade root portion connected to said platform; and a cooling system for cooling said platform, said cooling system comprising:

a first air passage extending radially through said blade root portion to said platform, said first air passage being arranged to cause a cooling air, which is supplied from said blade root portion, to pass into an interior of said platform in the vicinity of said blade head side of said platform;

a second air passage in communication with said first radially extending air passage, said second air passage being formed in the interior of said platform at said blade head side so as to extend parallel to an upper surface of said platform; and third and fourth air passages formed in the interior of said platform at opposite sides thereof so as to extend between said blade head side and said blade tail side of said platform, wherein said third and fourth air passages communicate with each other via said second air passage, and air can be released from each of said third and fourth air passages at an end face of said platform at said blade tail side of said platform.

3. A gas turbine blade comprising:

a platform having a blade head side and a blade tail side;

a blade portion extending from said platform;

a blade root portion connected to said platform; and a cooling system for cooling said platform, said cooling system comprising an air passage arranged to cause a cooling air, which is supplied from said blade root portion at said blade tail side of said platform, to pass sequentially through the interior of said platform in the vicinity of a blade tail side of said platform, through the interior of said platform at opposite sides of said platform between said blade tail side and said blade head side, and then be released in the direction of said blade root portion at positions in the vicinity of an end face of said platform at said blade head side of said platform.

* * * * *